US006334795B1

(12) United States Patent
Lin

(10) Patent No.: US 6,334,795 B1
(45) Date of Patent: Jan. 1, 2002

(54) STRUCTURE OF A CORDLESS PHONE PLUG

(76) Inventor: Ching-Yu Lin, No. 30, Lane 455, YueMei Street, LuoDong Town, YiLan County (TW)

( * ) Notice: Subject to any disclaimer, the term of this patent is extended or adjusted under 35 U.S.C. 154(b) by 0 days.

(21) Appl. No.: 09/662,760

(22) Filed: Sep. 15, 2000

(51) Int. Cl.[7] ..... H01R 13/514
(52) U.S. Cl. ..... 439/686; 439/901
(58) Field of Search ..... 439/607, 609, 439/610, 686, 695, 687, 696, 901

(56) References Cited

U.S. PATENT DOCUMENTS 5,470,261 A * 11/1995 Embo et al. ..... 439/686
5,667,407 A * 9/1997 Frommer et al. ..... 439/610
5,836,774 A * 11/1998 Tan et al. ..... 439/610
6,135,823 A * 10/2000 Torii ..... 439/686

* cited by examiner

*Primary Examiner*—Gary F. Paumen
*Assistant Examiner*—James R. Harvey
(74) *Attorney, Agent, or Firm*—Rosenberg, Klein & Lee

(57) ABSTRACT

An improved structure of a cordless phone plug comprising wiring, a base seat, an upper covering hood, a lower covering hood and an insertion-pin positioning member within an enclosed housing, the front end of the base seat extended from the open end of the housing forming into a connection end of the plug, the wiring being mounted at the wiring positioning board and the base seat being provided with a plurality of insertion-pins and arranged in two horizontal rows, and every insertion-pins being soldered. The upper covering hood and the lower covering hood cover the base seat. The insertion-pin positioning member is provided at a space between the two rows of the insertion-pins and are urged at the wiring positioning board by the U-shape seat. The present plug structure provides a good positioning of insertion pins and simplifies the assembly operation of the plug.

1 Claim, 3 Drawing Sheets

STRUCTURE OF A CORDLESS PHONE PLUG

BACKGROUND OF THE INVENTION (a) Technical Field of the Invention

The present invention relates to a cordless phone plug, and in particular, to an insertion-pin positioning member having a specific structure mounted at a space formed between two rows of insertion-pins located at the rear end of a base seat for the phone plug. The phone plug structure simplifies assembling procedures, and the insertion-pins are securely mounted.

(b) Description of the Prior Art

Cordless phone plugs are widely used in hand phones to provide external charging of battery or hand free operation. The basic structure of such a conventional plug is a standard plug mounted to a standard insertion slot located at the bottom section of the plug such that the two corresponding terminals of the phone and the plug are mounted to each other, thereby, through the connection of all the individual wiring, such as signal wires and/or power source wire, an electrically connected base is thus obtained.

In application, the conventional plug has drawbacks. The plug is manufactured in accordance with the standard plug, and due to the frequent plug-in and unplugged operation, the frequent friction between the insertion-pins with the insertion slots loosen the contacts of the two components. Thus, the plug cannot be smoothly mounted to a receptacle and more often, the contacts of the insertion-pins are poor.

Accordingly, it is a main object of the present invention to solve the above drawbacks by providing an improved structure of a cordless phone plug.

SUMMARY OF THE INVENTION

Accordingly, it is an object of the present invention to provide an improved structure of a cordless phone plug, wherein the plug structure has an enhanced rigid structure and will not be easily damaged, and the process of manufacturing and assembly thereof are thus simplified, and in turn, the cost of manufacturing is low Yet another object of the present invention is to provide an improved structure of a cordless phone plug, wherein an insertion-pin positioning member having specific structure is mounted at a space formed between two rows of insertion-pins located at the rear end of the base seat. Thus, this will simplify the assembly operation and the insertion-pins are rigid and the insertion-pins will not be damaged easily, and the longevity of the plug is improved.

One aspect of the present invention is to provide an improved structure of a cordless phone plug, comprising an insulation housing, wiring, a base seat, an upper covering hood, and a lower covering hood, wherein an insertion-pin positioning member is mounted at a space formed between two rows of the insertion-pins located at the rear end of the base seat, and an U-shaped seat at the rear end of the positioning member is urged at a wiring positioning board and each of the insertion-pins is securely positioned, and at the same time the distance between the base seat and the wiring positioning board is constant, thus the rigidity of the structure of the entire plug is improved.

Yet another aspect of the present invention is to provide an improved structure of a cordless phone plug wherein the positioning member is mounted in between the base seat 22 and the wiring mounting plate without any locking operation or drilling a hole on the plug components, or injection of a glue process. Thus, as compared to the conventional method of assembly, the present claimed invention is simpler, and the cost of manufacturing is low.

Various other objects, advantages and features of the present invention will become readily apparent from the ensuing detailed description and the novel features which will be particularly pointed out in the appended claims.

DETAILED DESCRIPTION OF THE PREFERRED EMBODIMENT

Figure 2:
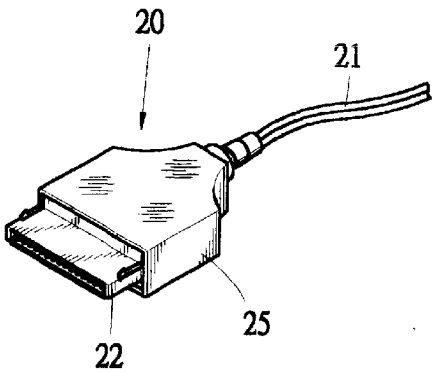
FIG. 2 is a perspective view of a cordless phone plug of the present invention.
Figure 1:
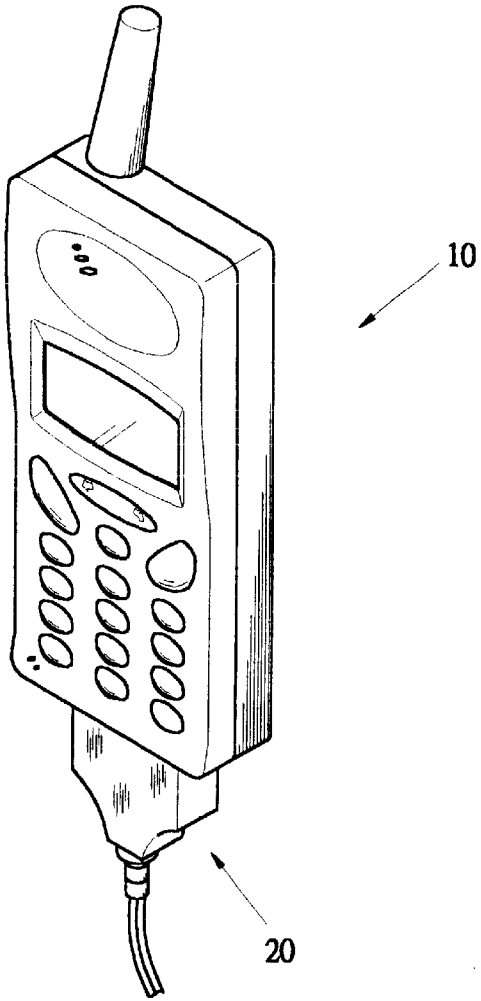
FIG. 1 shows an application of the preferred embodiment of a cordless phone plug in accordance with the present invention.

Referring to FIGS. 1 and 2, there is shown an improved structure of a cordless phone plug 20 which is used to insert into a standard insertion slot provided at the bottom section of a cordless hand phone 10 to form into an electrical communication for the connection with an external device as battery-charging, or hand free operation of phone.

Figure 3:
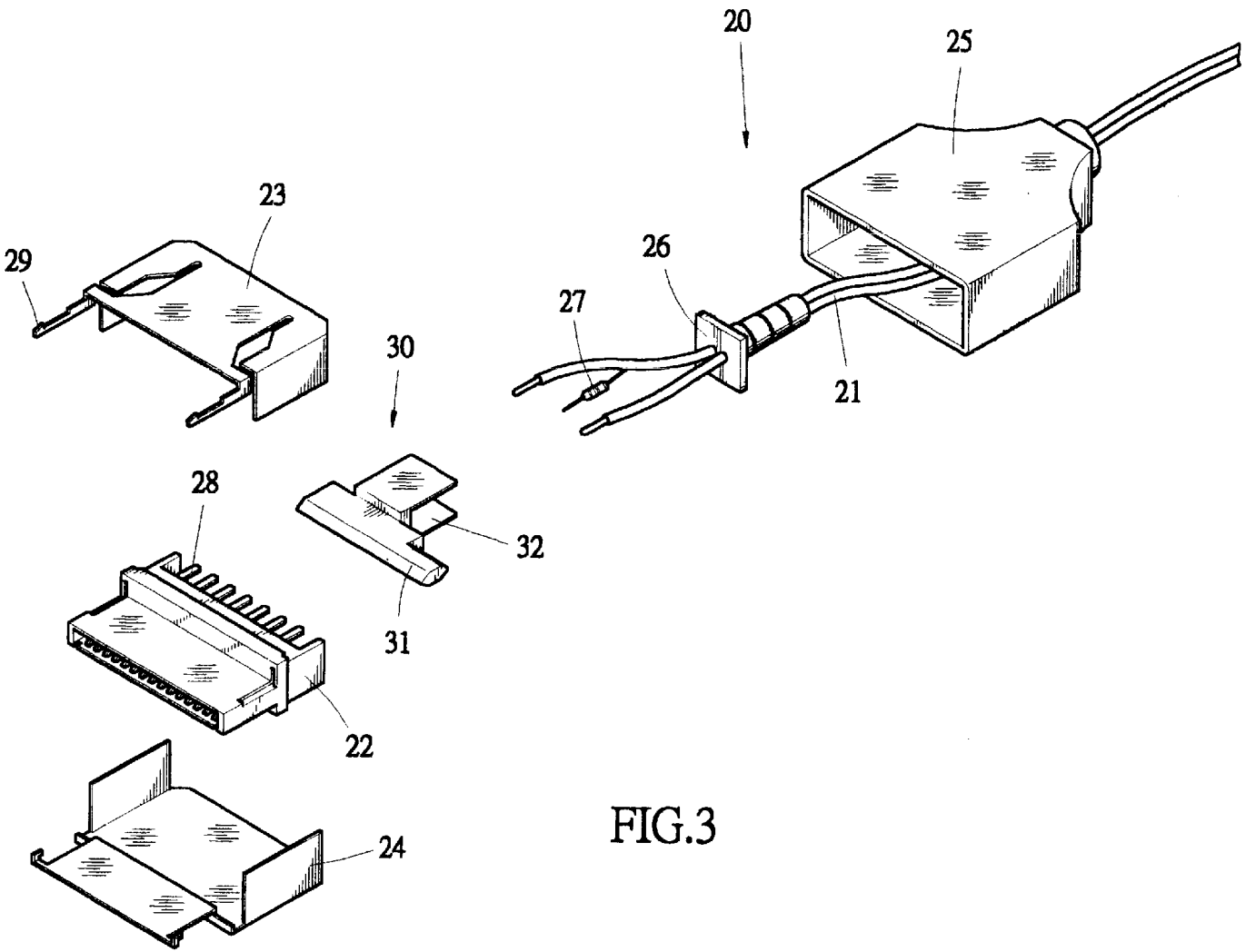
FIG. 3 is a perspective exploded view of a cordless phone plug of the present invention.

As shown in FIGS. 2 and 3, the cordless phone plug 20 comprises wiring 21, a base seat 22, an upper covering hood 23, a lower covering hood 24 and an insertion-pin positioning member 30. All those components are enclosed within an insulation housing 25, and the front end of the base seat 22 is extended out from the open end of the housing 25, and forms into a connection end of the plug 20.

FIG. 3 shows the cordless phone plug 20 in accordance with the present invention. As shown in FIG. 3, the wiring 21 are referred to a power source wire, a signal wire and cables. In the figure, the wiring 21 of the present inventions are shown as power source wiring.

As the wiring 21 are provided on a wiring positioning board 26, and the positioning board 26 urges the interior of the insulation housing 25 so as to position the wiring 21. The end terminal of the wiring 21 is provided with a single wire to connect to an anti-surge coil 27 to prevent instantaneous high voltage. Together with the two electrodes of the wiring, they form into a plurality of connection points, which can be soldered to the insertion-pins 28 of the base seat 22 to form an electrical communication.

The base seat 22 includes a plurality of insertion-pins, which are arranged into two horizontal rows. Each of the insertion-pins can be soldered to the signal connection point or power source connection point of the wiring 21 for connection to the external device.

The upper covering hood 23 is provided with a spring fastener 28 at the front end thereof, and together with the lower covering hood 24, they are enclosed by the base seat 22, forming into a base seat 22 with an outer metallic covering hood.

Figure 4:
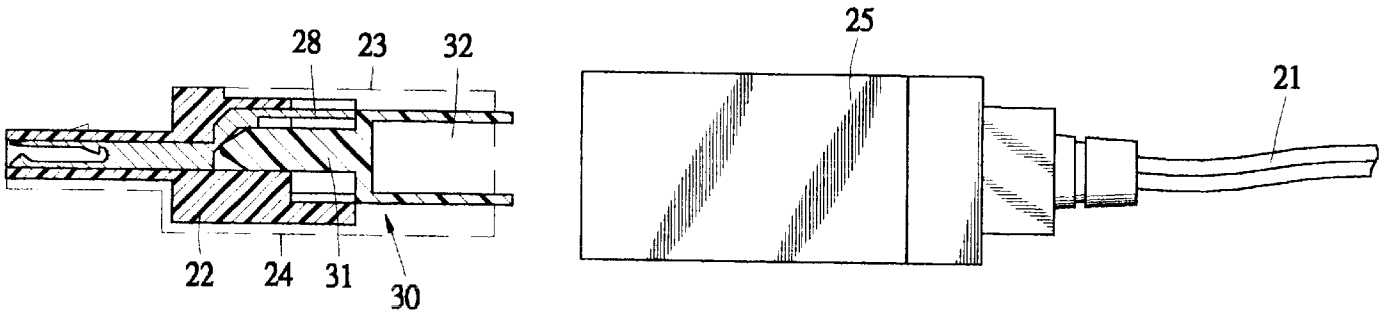
FIG. 4 is a sectional view of a cordless phone plug of the present invention, showing the structure of a positioning member.
Figure 5:
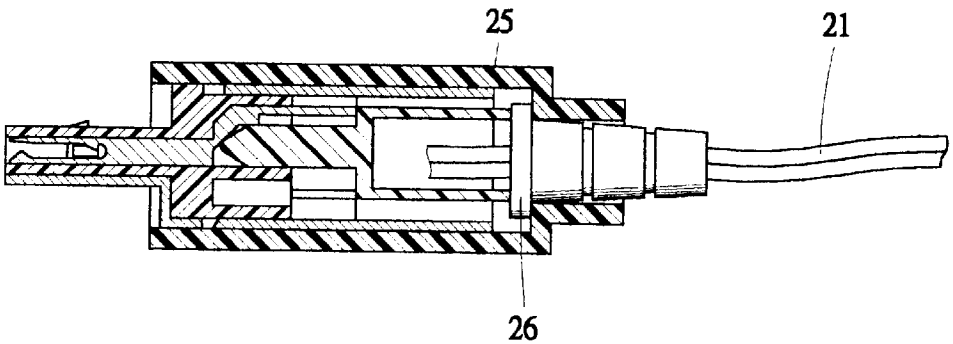
FIG. 5 is a sectional view of a cordless phone plug of the present invention, showing the structure of various components.

As shown in FIGS. 3, 4 and 5, the insertion-pins positioning member 30 is formed as one unit and includes a transverse direction positioning seat 31 at the front end thereof, an U-shaped seat 32 integrally connected from the rear end of the transverse direction positioning seat 31, and the U-shaped opening facing backward, which is corresponding to the wiring positioning board 26.

In assembly the insertion-pin positioning member 30, the positioning seat 31 at the front end of the positioning member 30 is directly mounted at a space formed between the two rows of insertion-pins 28 at the base seat 22. As shown in FIG. 4, the U-shaped seat 32 at the rear end of the positioning member 30 can exactly urge against the wiring positioning board 26 within the housing 25 to form into a secured positioning structure, which is shown in FIG. 5.

Due to the fact that the insertion-pin positioning member 30 located in between the base seat 22 and the wiring positioning board 26, and the transverse positioning seat 31 at the front end of the positioning member 30 being exactly located at the space between the two rows of the insertion-pins 28 at the rear end of the base 22, every insertion-pin 28 is urged by the positioning seat 31 and is formed into a secured positioning structure. Therefore, even the plug is often unplugged; the insertion-pins 28 will not be dislocated.

In additional, the U-shaped seat 32 at the rear end of the positioning member 30 urges the wiring positioning board 26 such that the base 22 is securely mounted within the insulation housing 25, and at the same time the U-shaped space of the U-shaped seat 32 can accommodate any other the additional parts and other supplementary parts of the end terminal of the wiring 21, for instance, the anti-surge coil 27 is protected within the U-shaped space.

As compared with the conventional cordless phone plug, the present claimed invention allows the individual components within the insulation housing 25 to be securely positioned by means of the positioning member 30 and upgrades the rigid structure of the plug. In additional, the transverse positioning seat 31 at the front end of the positioning member 30 allows the insertion-pins 28 not to be dislocated by means of the urging of the positioning seat 31. Further, in assembling this positioning member 30, the positioning member 30 is mounted in between the base seat 22 and the wiring positioning plate 26 without any locking operation or drilling a hole on the plug components, or injection of a glue process. Thus, as compared to the conventional method of assembly, the present claimed invention is easy and quick, and the cost of manufacturing is low.

While the invention has been described with respect to preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claims.

What is claimed is:

1. An improved structure of a cordless phone plug including wiring, a base seat, an upper covering hood, a lower covering hood and an insertion-pin positioning member within an insulative enclosed housing, the front end of the base seat extending from an open end of the housing thus forming a connection end of the plug, the wiring being mounted at a wiring positioning board, and the base seat being provided with a plurality of insertion-pins arranged in two horizontal rows, each insertion-pin being soldered at a wiring connection point for use as a communication signal source or a power charging source, the upper covering hood and the lower covering hood covering the base seat, characterized in that the insertion-pin positioning member is formed as one piece from an insulation body, and the insertion-pin positioning member comprises a transverse positioning seat at the front end of the positioning member, and an U-shaped seat integrally connected to the rear end of the transverse positioning seat, a U-shaped opening of the U-shaped seat faces rearwardly, the transverse positioning seat is directly mounted in a space between two rows of insertion-pins located at the rear end of the base seat, the U-shaped seat positioning the wiring board within the housing and forms into a secured.

* * * * *